United States Patent [19]

Herion

[11] 3,999,099

[45] Dec. 21, 1976

[54] ELECTRICAL RECEPTACLE DEVICE WITH MAIN LAMP AND THERMOSTATICALLY-CONTROLLED AUXILIARY LAMP SOCKETS

[76] Inventor: Henry Herion, 216 Sutherland St., City Island, N.Y. 10464

[22] Filed: Apr. 12, 1976

[21] Appl. No.: 676,101

[52] U.S. Cl. ..... 315/93; 315/90; 337/1

[51] Int. Cl.[2] ..... H05B 39/10; H05B 41/46

[58] Field of Search ..... 315/93, 90, 88; 337/1, 337/2, 3

[56] References Cited

UNITED STATES PATENTS

| | | | |
|---|---|---|---|
| 1,967,521 | 7/1934 | Venard | 315/93 |
| 3,401,368 | 9/1968 | Herion | 337/1 |

*Primary Examiner*—Harold Broome
*Attorney, Agent, or Firm*—Ernest H. Schmidt

[57] ABSTRACT

An electrical receptacle device having a main lamp socket and an auxiliary socket adapted to receive an auxiliary lamp operative only upon failure of a main lamp in a main lamp socket. The two sockets are arranged in aligned opposition in a common housing providing a heating chamber in spaced, parallel relation with respect to the screw base ferrules along one side thereof. A slightly curved, elongated bi-metallic switch element extends along and within the heating chamber, having one end affixed to the main lamp socket ferrule and the other end positioned for movement in and out of contact, selectively, with the auxiliary lamp socket in response to temperature conditions in the heating chamber effected by non-operation and operation, respectively of a main lamp in the main lamp socket. The socket housing is integrally molded with a neck portion extending outwardly of the side opposite the heating chamber to terminate in a screw-in fitting for electrical connection in a ordinary lamp socket source of electrical supply. Externally-controlled adjustment means is provided for regulating the temperature change at which the auxiliary lamp socket is energized, to accommodate for variations in ambient temperature in the environment in which the thermostatically controlled receptacle device is installed.

6 Claims, 3 Drawing Figures

ELECTRICAL RECEPTACLE DEVICE WITH MAIN LAMP AND THERMOSTATICALLY-CONTROLLED AUXILIARY LAMP SOCKETS

In my U.S. Pat. No. 3,401,368, issued Sept. 10, 1968 I disclose an electrical lamp receptacle device for warning of failure of an associated main lamp and at the same time providing illumination from an auxiliary lamp until the failure is corrected by replacement of the main lamp. Such devices have application particularly in multiple dwelling buildings, factories, hospitals, schools, institutions and other buildings wherein it is necessary for public safety and often required by law to have continuous illumination in hallways, stairways, entrances and exits, in cellars, etc. The device of the above-mentioned patents insures that illumination continues by the automatic energization of an auxiliary lamp upon burn-out or breakage of the main lamp, and that warning is thereby given so that the custodian will make the necessary lamp replacement. Such devices heretofore devised, however, are deficient in various respects, principally in that the bimetallic auxiliary lamp switching element cannot be adjusted or regulated to adapt to the surrounding or ambient temperature in which the receptacle device is installed. Thus, if installed in a lower temperature location, such as in an outdoor receptacle during winter time, the switching to auxiliary illumination upon failure of the main lamp might be fairly rapid, resulting in a very short period of non-illumination, whereas the same receptacle device during the heat of summer would be slow to respond to failure of the main lamp, resulting in a comparatively long period without emergency illumination.

It is, accordingly, the principal object of this invention to provide an improved and simplified electrical lamp receptacle device of the character described above wherein the thermostatically controlled means for energizing the auxiliary lamp in the auxiliary socket upon failure of a lamp in the main socket is readily adjustable without the necessity for disassembling the receptacle device housing, so as to provide for a minimum "black-out" interval upon failure of a main lamp and subsequent energization of the auxiliary lamp, irrespective of surrounding temperature conditions.

A more particular object of the invention is to provide a lamp receptacle device of the above nature wherein the auxiliary lamp socket energizing bi-metallic switch comprises a regulating screw threaded in the outer, contacting end of said bi-metallic switch element, the screw having an inner end serving to make switching contact with the auxiliary lamp socket ferrule and an outer end projecting through the receptacle device housing to terminate in a screw driver slot for switch response regulating adjustment.

Another object is to provide an improved thermostatically-controlled electric lamp receptacle device of the above nature which, because of its simplicity, low-cost, compactness and ease of installation, is particularly well-suited to use in small apartment buildings and low-cost public housing.

Other object, features and advantages of the invention will be apparent from the following description when read with reference to the accompanying drawings. In the drawings, wherein like reference numerals denote corresponding parts throughout the several views.

Referring now in detail to the drawings, 10 designates a thermostatically-controlled lamp receptacle embodying the invention, illustrated equipped with a main lamp M as a principal source of illumination and an auxiliary lamp A serving to provide illumination only upon failure due to burn-out or breakage of the main lamp, the device including adjustable heat-responsive means controlled by the energization of the main lamp for energizing the screw-base socket ferrule of the auxiliary lamp, as is hereinbelow described.

Figure 1:
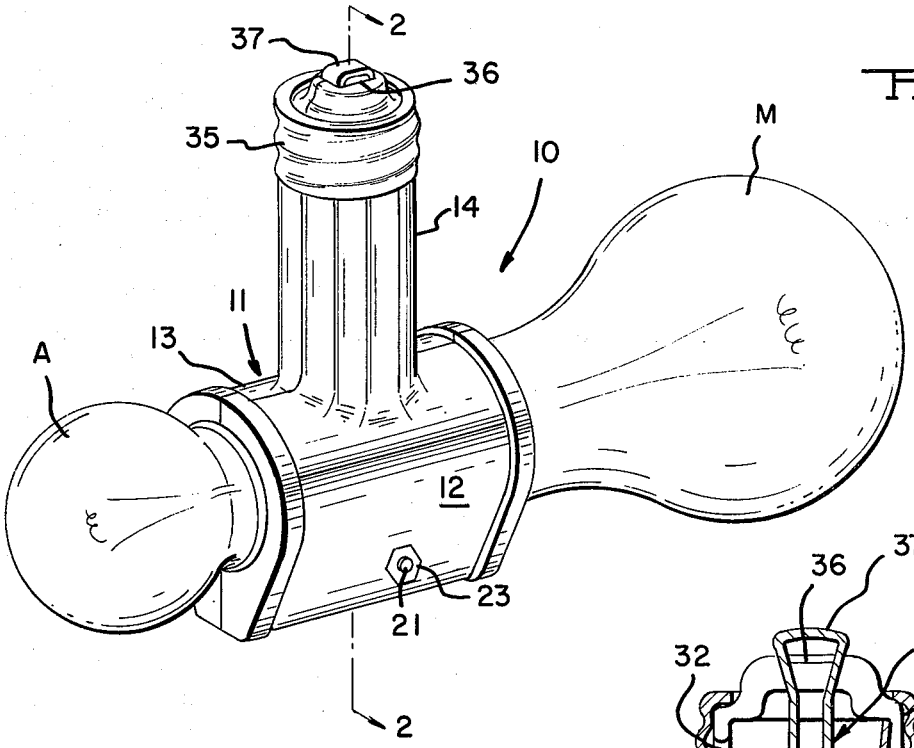
FIG. 1 is a perspective view of a thermostatically-controlled lamp receptacle device embodying the invention, shown fitted with main and auxiliary lamps.
Figure 2:
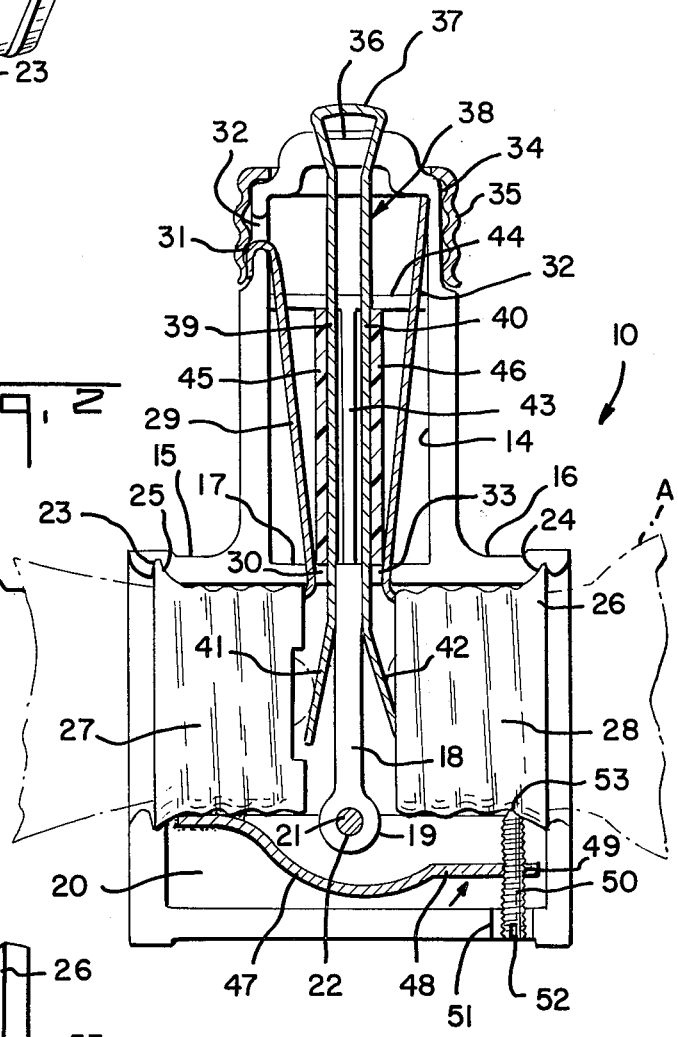
FIG. 2 is a vertical cross-sectional view of the receptacle device, taken along the plane indicated at 2–2 of FIG. 1 and on an enlarged scale.

The receptacle device 10 comprises a housing 11 having complemental, longitudinally-divided half-shell members 12, 13, which are preferably molded of a tough non-electrically conductive material such as Bakelite. Referring to FIGS. 1 and 2 it will be seen that the half-shell members 12 and 13 are each integrally formed with an upwardly-extending neck portion 14 and opposed, horizontally-extending lamp socket receptacle portions 15 and 16 together defining a generally T-shaped peripheral configuration.

The base receptacle portions 15, 16 of each of the half-shell members 12, 13 are integrally formed with a transverse wall 17 at the lower end of the hollow neck portion 14. The socket base receptacle portions 15 and 16 are also formed with a central, vertical dividing wall 18 extending from the transverse wall 17 and terminating somewhat short of the lower or opposite end of the base receptacle portions 15, 16 in a circular boss portion 19. As illustrated in FIGS. 1 and 2, the underside of the socket base receptacle portions 15 and 16 extends outwardly somewhat from their generally cylindrical configuration to provide a bi-metallic switch heat chamber 20 upon assembly of the longitudinally-divided half-shell members 12, 13, said assembly being effected, in part, by a transversely-extending machine screw 21 received through openings 22 in the bosses 19 and secured in place as by recessed nut 23 (see FIG. 1).

As best illustrated in FIG. 2, the socket base receptacle portions 15 and 16 are integrally molded, near the outer ends thereof, with internal annular grooves 23, 24 adapted to receive outwardly-flared lip portions 25, 26 of main lamp screw-base ferrule 27 and auxiliary screw-base ferrule 28, respectively, for retaining said ferrules in place. The main lamp screw base ferrule 27 has spot-welded or otherwise secured thereto near its inner end an elongated conductor strip 29 which extends through slot 30 in the transverse wall 17 and then upwardly within the vertical chamber defined by the hollow neck portion 14 to terminate in a reverse bend 31 extending through a horizontal slot 32 provided near the upper end of said hollow neck portion. The auxiliary lamp screw ferrule 29 similarly is provided with an elongated conductor strip 32, extending through slot 33 at the other side of vertical dividing wall 18 to terminate within the upper end of the hollow neck portion 14. As further illustrated in FIG. 2, the upper end of the hollow neck portion 14 is molded with an external screw thread 34 adapted to threadingly receive an externally and internally-threaded metal ferrule 35 which serves not only to secure the half-shell members 12 and 13 in inter-assembled relation along with machine screw 21 and nut 23, as described above, but also to make internal contact between said screw base ferrule and conductor strip 29 for energizing the device, as is hereinafter more particularly described.

The outer end of the hollow neck portion 14 extends into a reduceddiameter end portion terminating in a substantially rectangular opening 36 received within which and projecting slightly outwardly whereof is the double-bent portion 37 of a bent metal strip 38 serving as an electrical conductor between the central contact of the neck ferrule 35 and the central contacts of the screw base ferrules 27, 28. To this end, the metal strip 38 is symmetrical about its longitudinal center and provides downwardly-extending, side-by-side portions 39, 40 terminating in slightly outwardly bent terminal portions 41, 42, respectively, serving as center contact elements for the main and auxiliary lamps M and A, respectively. The bent metal strip 38 is preferably of hard brass, alloyed to provide substantial resiliency at the terminal contact end thereof. As additional means for holding the bent metal contact strip 38 in place, each downwardly extending portion 39, 40 is provided with opposed slots (not illustrated) at zones thereof passing through the respective transverse wall slots 30 and 33, to interhook with said slot and thereby inhibit vertical motion within the hollow neck portion 14. As further illustrated in FIG. 2, the interior of each of the half shell members 12, 13 comprising the neck portion of the housing 11 is integrally molded with a shallow, longitudinally-extending interior wall portion 43 terminating in a transverse boss portion 44. The opposed interior walls 43 and bosses 44 define recesses retaining in place hard fiber electrical insulating members 45, 46, which serve to insure against accidental short circuiting between the central contact metal strip and the respective main and auxiliary ferrule contact strips or conductors 29 and 32.

Figure 3:
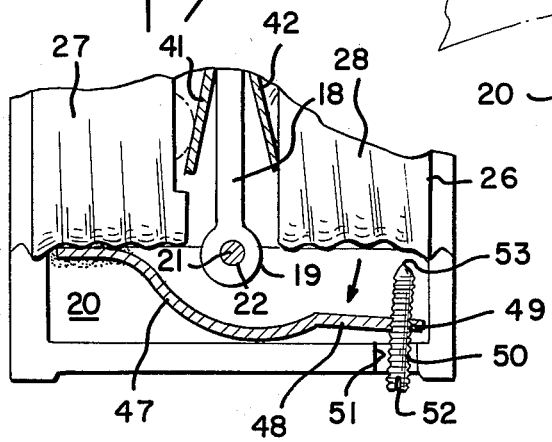
FIG. 3 is a partial view of the receptacle device as illustrated in FIG. 2, but showing the bi-metallic switch contacting element out of contact with the auxiliary lamp ferrule as in normal operation and prior to failure of the main illumination lamp.

Means is provided for energizing the auxiliary lamp A screwed into screw-base ferrule 28 only upon failure of an energized main lamp M in the main lamp socket comprising lamp screw-base ferrule 27. To this end, a slightly arcuate bi-metallic element 47 is disposed within the substantially rectangular chamber 20 defined within the half-shell members 11 and 12 at the lower end thereof, said bi-metallic element being welded at one end to the outside of the main lamp ferrule 27. The bi-metallic element 47 curves around the circular boss portion 19 to terminate in a slightly outwardly bent straight end portion 48 threaded, as indicated at 49, to receive a brass adjustment screw 50. The head of the adjustment screw 50 extends through an opening 51 in th bottom of the housing 11, and is provided with the usual slot or kerf 52 permitting screw driver adjsutment. It will be seen that normally, i.e., with the device de-energized, the contact tip portion 53 of the bi-metallic element adjustment screw 50 will be in contact with the metallic screw-base contact shell of ferrule 28 of the auxiliary lamp A. In operation it will thus be apparent that when the thermostatically controlled device 10 is first screwed into an electrical receptacle serving as a source of electrical supply, both the main lamp M and the auxiliary lamp A will be lighted or energized, the main lamp ferrule 27 being energized through its contact strip 29 connected to the energization ferrule 35, and the auxiliary lamp A being energized by electrical connection with the main lamp ferrule 28 through bi-metallic element 47 and contact screw 50 as described above. A short time after its having been energized, however, heat given off by the main lamp M will be conducted in sufficient quantity into the heating chamber 20 and the bi-metallic element 47 therein to effect withdrawal of the tip portion 53 of the bi-metallic element adjustment screw 50 out of contact with the metallic screw base ferrule 28 of the auxiliary lamp, thereby open-circuiting the energizing connection to said auxiliary lamp, as illustrated in FIG. 3. It is to be noted that the bi-metallic element 47 is so designed that when heated by heat radiated from the neck of a main lighting lamp M in the main light receptacle, through the receptacle ferrule 27, the outer end of said bi-metallic element rotates outwardly, as indicated by the arrow in FIG. 3, and away from the screw-base of the auxiliary lamp, within the confines of the heating chamber 20. It is further to be understood that the auxiliary lamp A, being of substantially lesser wattage than the main lamp M, will not, when energized as an emergency lighting lamp, give off sufficient heat to actuate, i.e., disconnect, the bi-metallic element.

In use, it is a simple matter to place my improved safety device in an ordinary lamp socket and screw main and auxiliary lamps in their respective sockets for operation as described above. Alternatively, an extension cord leading from the auxiliary lamp socket to a supervised remote place could be used to give, by means of a lamp or other signal device, warning that the associated main lamp needs replacement.

A salient feature of my invention resides in the provision of readily adjustable means for controlling the time interval between which the main illuminating lamp M fails and the auxiliary lamp A becomes energized for continued illumination, even though at reduced intensity. The bi-metallic element regulating screw makes it possible to adjust operation of the device to suit the particular surrounding or ambient temperature conditions for efficient operation without substantial time lag. The regulating screw, moreover, permits ready accommodation to seasonal changes in temperature to minimize intervals of "blackout" upon failure of the main lamp.

Another advantage resides in the T-shaped configuration of the housing structure wherein the main and auxiliary lamps extend perpendicularly outwardly of each side of the lower end of the energizing neck portion, the compactness of the receptacle device and associated lamps thereby achieved lending itself particularly well to installation in a wide range of shapes and sizes of ceiling fixtures without interference.

While I have illustrated and described herein only one form in which my invention can conveniently be embodied in practice, it is to be understood that this embodiment is given by way of example only and not in a limiting sense.

What I claim as new and desire to secure by Letters Patent is:

1. In an electrical receptacle device with main lamp and thermostatically-controlled auxiliary lamp sockets, the combination comprising, a housing member, a neck portion extending outwardly of one end of said housing member, a cylindrical screw plug ferrule enveloping said neck portion, said housing enclosing main and auxiliary lamp sockets in aligned, mutually-opposed disposition at the other end of said housing, said main and auxiliary sockets comprising main and auxiliary lamp socket ferrules, respectively, an elongated heating chamber within said housing and laterally-spaced with respect to said main and auxiliary lamp sockets, electrical conducting means interconnecting said screw plug ferrule and said main lamp socket ferrule, electrical circuit means interconnecting said main lamp socket ferrule and an auxiliary lamp in said auxiliary lamp socket, said electrical circuit means comprising heat responsive switch means in said heating chamber operative to open circuit in response to heat generated in said chamber by an energized lamp in said main lamp socket, said heat responsive switch means comprising an elongated bi-metallic element having one end fixed to said main lamp socket ferrule and the other end moveable, selectively in the direction towards and the direction away from said auxiliary lamp socket ferrule, and means for adjusting the positioning of said heat reponsive switch means with respect to said auxiliary lamp socket ferrule.

2. An electrical receptacle device as defined in claim 1, wherein said position adjusting means comprises an adjustment screw threadingly received in a through opening in said other end of said bi-metallic element, said adjustment screw having a contact tip portion at one end moveable into and out of contact with said auxiliary lamp ferrule, and a screw head at the opposite end accessible for screw-driver adjustment by way of a through opening in said housing.

3. An electrical receptacle device as defined in claim 2, wherein said housing is in the form of a pair of complemental half-shells, said cylindrical screw plug member serving to hold said half-shells together, and nut and bolt means between said sockets for holding said half-shalls together at the opposite end thereof.

4. An electrical receptacle device as defined in claim 3, each half-shell being formed with a recess, said recesses together defining said heating chamber, said bi-metallic element being enclosed wthin said heating chamber.

5. An electrical receptacle device as defined in claim 1 wherein said housing member neck portion and said main and auxiliary lamp socket and enclosing portions define a T-shaped configuration so that said main and auxiliary lamps placed in their respective socket ferrules extend perpendicularly outwardly of each side of said neck portion of said housing in opposing directions.

6. An electrical receptacle device as defined in claim 5 wherein said heating chamber within said housing extends along inner side portions of said main and auxiliary lamp socket ferrules opposite said neck extension portion.

* * * * *